US010801182B2

(12) United States Patent
Espinosa et al.

(10) Patent No.: US 10,801,182 B2
(45) Date of Patent: Oct. 13, 2020

(54) SYSTEM AND METHOD FOR CONTROLLING WORK VEHICLE OPERATION BASED ON MULTI-MODE IDENTIFICATION OF OPERATOR INPUTS

(71) Applicant: CNH Industrial America LLC, New Holland, PA (US)

(72) Inventors: Raul Espinosa, Pittsburgh, PA (US); Duqiang Wu, Bolingbrook, IL (US); Aditya Singh, Westmont, IL (US); Navneet Gulati, Naperville, IL (US)

(73) Assignee: CNH Industrial America LLC, New Holland, PA (US)

( * ) Notice: Subject to any disclaimer, the term of this patent is extended or adjusted under 35 U.S.C. 154(b) by 172 days.

(21) Appl. No.: 16/165,874

(22) Filed: Oct. 19, 2018

(65) Prior Publication Data

US 2020/0123738 A1 Apr. 23, 2020

(51) Int. Cl.

| | |
|---|---|
| ***E02F 9/22*** | (2006.01) |
| ***E02F 9/20*** | (2006.01) |
| ***E02F 3/43*** | (2006.01) |

(52) U.S. Cl.

CPC ..... *E02F 9/2228* (2013.01); *E02F 9/2004* (2013.01); *E02F 9/2025* (2013.01); *E02F 9/2271* (2013.01); *E02F 3/431* (2013.01)

(58) Field of Classification Search

CPC ..... E02F 9/2228; E02F 9/2004; E02F 9/2025; E02F 9/2271

See application file for complete search history.

(56) References Cited

U.S. PATENT DOCUMENTS

| | | | | |
|---|---|---|---|---|
| 5,860,231 | A | 1/1999 | Lee et al. | |
| 6,725,105 | B2 | 4/2004 | Francis et al. | |
| 7,114,747 | B2 | 10/2006 | Dix et al. | |
| 7,117,952 | B2 | 10/2006 | Bares et al. | |
| 7,571,604 | B2 | 8/2009 | Vigholm et al. | |
| 7,726,125 | B2 | 6/2010 | Brinkman et al. | |
| 7,866,149 | B2 | 1/2011 | Brinkman et al. | |
| 8,214,097 | B2 * | 7/2012 | Severinsky | B60K 6/46 701/22 |
| 9,085,440 | B2 | 7/2015 | Choi | |
| 2003/0097595 | A1 * | 5/2003 | Partridge | H04L 63/1408 726/4 |
| 2004/0003977 | A1 * | 1/2004 | Schiele | F16D 25/123 192/70.12 |
| 2004/0209718 | A1 * | 10/2004 | Ishibashi | F16H 61/465 474/18 |
| 2005/0203691 | A1 | 9/2005 | Kim | |

(Continued)

*Primary Examiner* — Hussein Elchanti

(74) *Attorney, Agent, or Firm* — Peter Zacharias; Patrick Sheldrake

(57) ABSTRACT

In one aspect, the present subject matter is directed to a system and method for controlling the operation of a work vehicle based on the multi-mode identification of operator inputs. Specifically, the movement of an input device of the work vehicle may be monitored relative to two or more movement ranges defined within or across the range of positions defining the input device's overall travel range. When it is detected that the operator has made a pattern of input device movements relative to one of the movement ranges, a new operating mode may be selected or activated that adjusts the transfer function used to control the movement of a component of the work vehicle based on the position of the input device.

20 Claims, 7 Drawing Sheets

(56) References Cited

U.S. PATENT DOCUMENTS

| | | | | |
|---|---|---|---|---|
| 2005/0211528 | A1* | 9/2005 | Hou | B60W 30/1888 192/85.63 |
| 2006/0110247 | A1* | 5/2006 | Nelson | F01D 11/122 415/173.4 |
| 2008/0296032 | A1* | 12/2008 | Masumoto | E02F 9/2275 172/321 |
| 2009/0084623 | A1* | 4/2009 | Dagenais | B60W 30/02 180/210 |
| 2010/0082192 | A1* | 4/2010 | Hofbauer | B60L 50/61 701/22 |
| 2010/0186778 | A1* | 7/2010 | Martin | B08B 3/024 134/34 |
| 2011/0204712 | A1* | 8/2011 | Tarasinski | A01B 59/06 307/9.1 |
| 2014/0156129 | A1* | 6/2014 | Tabata | B60K 6/48 701/22 |
| 2014/0230785 | A1* | 8/2014 | Kawaguchi | F02D 11/06 123/349 |

* cited by examiner

SYSTEM AND METHOD FOR CONTROLLING WORK VEHICLE OPERATION BASED ON MULTI-MODE IDENTIFICATION OF OPERATOR INPUTS

FIELD OF THE INVENTION

The present subject matter relates generally to work vehicles and, more particularly, to a system and method for controlling the operation of a work vehicle based on multi-mode identification of operator inputs (e.g., inputs received from a control lever).

BACKGROUND OF THE INVENTION

Work vehicles having loader arms, such as wheel loaders, skid steer loaders, backhoe loaders, compact track loaders, and the like, are a mainstay of construction work and industry. For example, wheel loaders typically include a pair of loader arms pivotally coupled to the vehicle's chassis that can be raised and lowered at the operator's command. The loader arms typically have an implement attached to their end, thereby allowing the implement to be moved relative to the ground as the loader arms are raised and lowered. For example, a bucket is often coupled to the loader arms, which allows the wheel loader to be used to carry supplies or particulate matter, such as gravel, sand, or dirt, around a worksite. Typically, the bucket of a wheel loader is pivotally coupled to the loader arms to allow the implement to be pivoted or tilted relative to the loader arms across a plurality of positions. For instance, the bucket may be titled between a max curl position (e.g., at which the open portion of the bucket is facing upward) and a max dump position (e.g., at which the open portion of the bucket is facing downward).

During operation of a wheel loader or other work vehicle of similar construction, a need arises every so often to rapidly move the implement back and forth relative to the loader arms (e.g., to shake the implement). For instance, an operator may desire to shake the implement to remove dirt, debris, or other materials that have accumulated or otherwise become stuck on the implement. To executing such implement shaking, the operator is required to move the control lever or joystick controlling the operation of the associated tilt cylinder back and forth quickly. However, the responsiveness of the vehicle's hydraulic system to such rapid movements of the control lever are often too slow to provide the desired shaking of the implement. For instance, the transfer function correlating the control lever movements to the flow rate of the hydraulic fluid supplied to the tilt cylinder may not allow for a rapid increase in the flow rate. As a result, the operator may not be allowed to shake the implement in the manner required to achieve the desired operation.

Accordingly, a system and method for controlling the operation of a work vehicle that allows the movement of an implement to be regulated according to two or more different transfer functions to allow the operator to controller implement movements in two or more different operating modes (e.g., a normal mode and a shake mode) would be welcomed in the technology. Additionally, a system and method that allows such control to be based on multi-mode identification of operator inputs (e.g., inputs received from a control lever) would also be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a method for controlling the operation of a work vehicle. The method includes initially controlling, with a computing device, an operation of an actuator of a work vehicle based at least in part on a baseline transfer function correlating a position of an input device of the work vehicle to a flow rate of fluid supplied to the actuator, with the input device being movable across a range of positions. The method also includes monitoring, with the computing device, movement of the input device relative to first and second movement ranges defined across portions of the range of positions, the first movement range corresponding to a first sub-range of the range of positions and the second movement range corresponding to a second sub-range of the range of positions, with the first sub-range of positions differing from the second sub-range of positions. In addition, the method includes detecting, with the computing device, a pattern of input device movements relative to one of the first movement range or the second movement range and selecting, with the computing device, an adjusted transfer function for correlating the position of the input device to the flow rate from one of a first adjusted transfer function associated with the first movement range or a second adjusted transfer function associated with the second movement range based on whether the detected pattern of input device movements was relative to the first movement range or the second movement range, with the first and second adjusted transfer functions differing from each other and from the baseline transfer function. Moreover, the method includes controlling, with the computing device, the operation of the actuator based at least in part on the adjusted transfer function to control movement of a component of the work vehicle coupled to the actuator.

In another aspect, the present subject matter is directed to a system for controlling the operation of a work vehicle. The system includes an implement and an actuator coupled to the implement, with the actuator being configured to move the implement across a plurality of implement positions. The system also includes an input device configured to receive operator inputs for controlling the operation of the actuator based on a position of the input device, with the input device being movable across a range of positions. In addition, the system includes a controller communicatively coupled to the input device. The controller is configured to initially control the operation of the actuator based at least in part on a baseline transfer function correlating the position of the input device to a flow rate of fluid supplied to the actuator. The controller is further configured to monitor the movement of the input device relative to first and second movement ranges defined across portions of the range of positions of the input device, the first movement range corresponding to a first sub-range of the range of positions and the second movement range corresponding to a second sub-range of the range of positions, with the first sub-range of positions differing from the second sub-range of positions. In addition, the controller is configured to detect a pattern of input device movements relative to one of the first movement range or the second movement range and select an adjusted transfer function for correlating the position of the input device to the flow rate from one of a first adjusted transfer function associated with the first movement range or a second adjusted transfer function associated with the second movement range based on whether the detected pattern of input device movements was relative to the first movement range or the second movement range, with the first and second adjusted transfer functions differing from each other and from the baseline transfer function. Moreover, the controller is configured to control the operation of the actuator based at least in part on the adjusted transfer function to control the movement of the implement.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
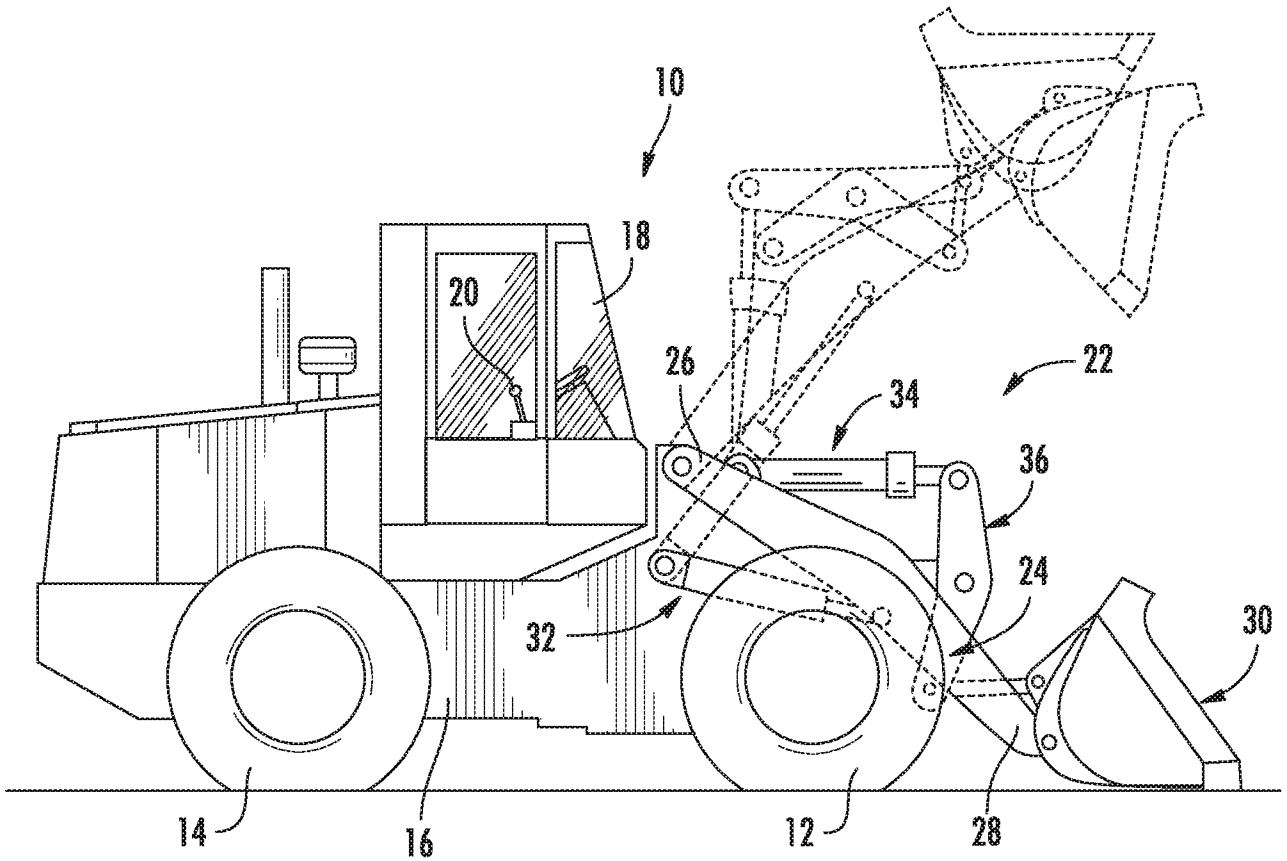
FIG. 1 illustrates a side view of one embodiment of a work vehicle in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for controlling the operation of a work vehicle. Specifically, in several embodiments, the disclosed system and method may be used to control the movements of an implement of a work vehicle, such as the bucket on a front loader, based on operator input received from a control lever. For example, in accordance with aspects of the present subject matter, the implement movement may be controlled within a plurality of different operating modes (e.g., one or more implement shake modes and/or one or more precision movement modes), with each operating mode being associated with a unique transfer function or control curve that correlates the position of the control lever to the flow rate of the hydraulic fluid supplied to an actuator configured to move the implement. Additionally, each operating mode may be associated with or assigned to a specific range of lever positions or "lever movement ranges" defined within or across the control lever's overall travel range. In such embodiments, by monitoring the position of the control lever relative to the various lever movement ranges as the operator moves the lever, it may be detected when the operator has moved the lever across or relative to one of the lever movement ranges according to a predetermined pattern. Upon detection of the predetermined pattern of movements relative to a given lever movement range, the transfer function being utilized for correlating the lever position to the flow rate may be switched from the system's default or normal transfer function to the transfer function associated with such lever movement range, thereby allowing the movement of the implement to be controlled in accordance with the selected operating mode.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other work vehicle including movable loader arms (e.g., any other type of front loader, such as skid steer loaders, backhoe loaders, compact track loaders and/or the like).

As shown in FIG. 1, the work vehicle 10 includes a pair of front wheels 12, a pair or rear wheels 14 and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10.

For instance, as shown in FIG. 1, the work vehicle 10 may include one or more control levers 20 for controlling the operation of one or more components of a lift assembly 22 of the work vehicle 10.

As shown in FIG. 1, the lift assembly 22 may include a pair of loader arms 24 (one of which is shown) extending lengthwise between a first end 26 and a second end 28, with the first ends 26 of the loader arms 24 being pivotally coupled to the chassis 16 and the second ends 28 of the loader arms 24 being pivotally coupled to a suitable implement 30 of the work vehicle. (e.g., a bucket, fork, blade, and/or the like). In addition, the lift assembly 22 also includes a plurality of actuators for controlling the movement of the loader arms 24 and the implement 30. For instance, the lift assembly 22 may include a pair of hydraulic lift cylinders 32 (one of which is shown) coupled between the chassis 16 and the loader arms 24 for raising and lowering the loader arms 24 relative to the ground and a pair of hydraulic tilt cylinders 34 (one of which is shown) for tilting or pivoting the implement 30 relative to the loader arms 24 (e.g., between dump and curl positions). As shown in the illustrated embodiment, each tilt cylinder 34 may, for example, be coupled to the implement 30 via a linkage or lever arm 36. In such an embodiment, extension or retraction of the tilt cylinders 34 may result in the lever arm 36 pivoting about a given pivot point to tilt the implement 30 relative to the loader arms 24.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 32 and a pair of tilt cylinders 34. However, in other embodiments, the work vehicle 10 may, instead, include any number of lift cylinders 32 and/or tilt cylinders 24, such as by only including a single lift cylinder 32 for controlling the movement of the loader arms 24 and/or a single tilt cylinder 34 for controlling the movement of the implement 30.

Figure 2:
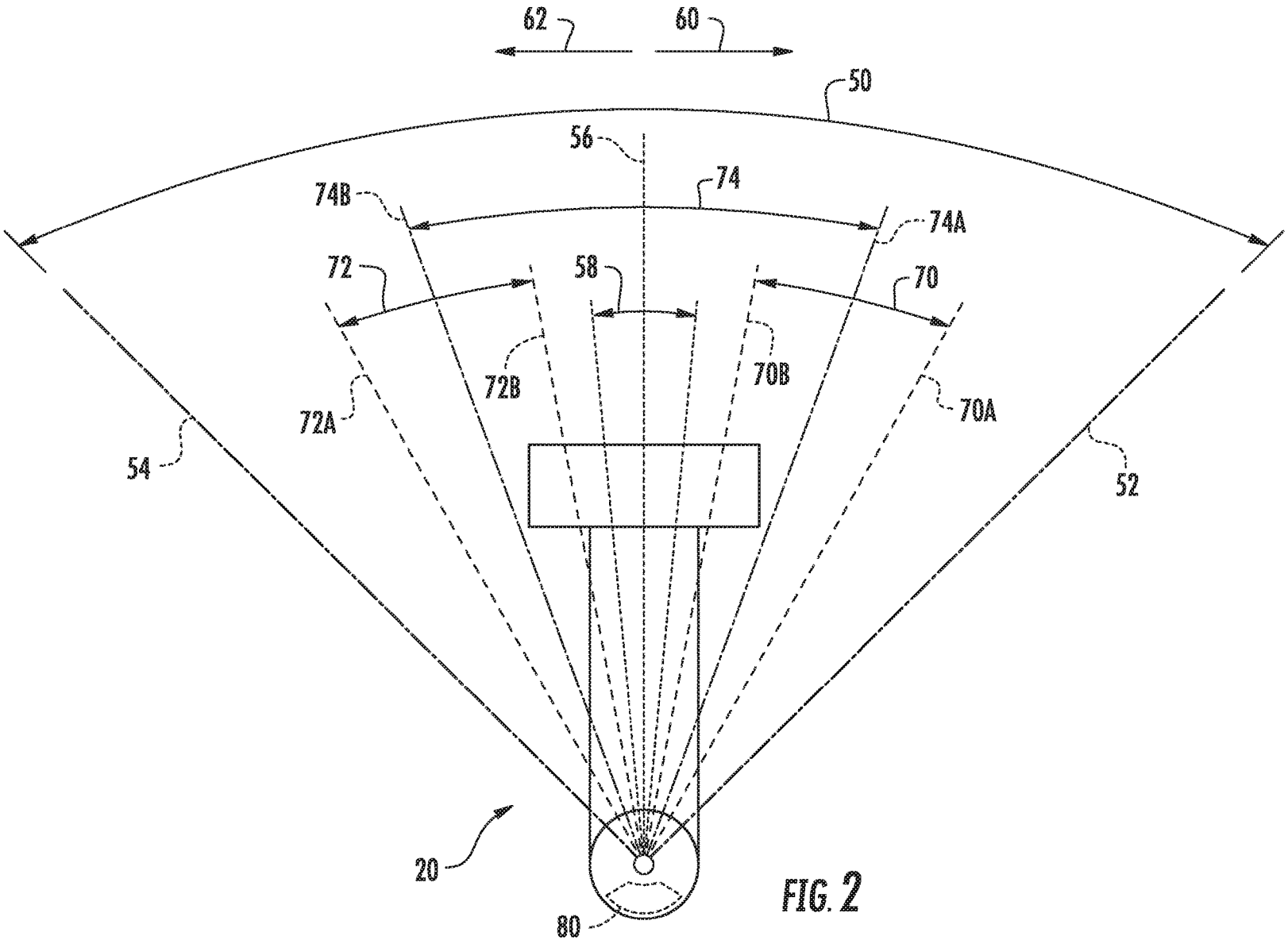
FIG. 2 illustrates a schematic view of one embodiment of an input device suitable for use with the work vehicle shown in FIG. 1, particularly illustrating various identified position ranges for the input device across its overall travel range.

Referring now to FIG. 2, a schematic view of one embodiment of an input device suitable for use with the work vehicle 10 described above with reference to FIG. 1 is illustrated in accordance with aspects of the present subject matter. Specifically, in the illustrated embodiment, the input device is configured as a control lever (e.g., lever 20 of FIG. 1), which, as used herein, generally refers to any suitable input device configured to be moved or pivoted across a range of positions (e.g., including joysticks and similar input devices). For purposes of the present disclosure, the control lever 20 will generally be described with reference to providing operator inputs for controlling the operation of the tilt cylinders 34, thereby allowing the operator to control the tilting or movement of the implement 30 relative to the loader arms 24. However, it should be appreciated that the control lever 20 may generally be configured to control any suitable component(s) of the work vehicle 10, such as the lift cylinders 32.

As shown, the control lever 20 has an overall travel range 50 including a plurality of lever positions defined between a first maximum position (indicated by line 52) and a second maximum position (indicated by line 54). Additionally, the travel range 50 for the control lever 20 may be centered or defined relative to a central lever position (indicated by line 56). In several embodiments, a neutral position range 58 for the control lever 20 may be defined relative to the center lever position 56. As is generally understood, the amount or range of lever positions included within the neutral position range 58 generally corresponds to the "neutral position" for the control lever 20 at which the control output is equal to zero or is otherwise associated with the operator not commanding movement of the implement 30. It should be appreciated that the specific range of lever positions included within the neutral position range 58 may generally vary depending on the lever configuration and/or the configuration of the associated hydraulic/control system. For instance, in one embodiment, the neutral position range 58 may span a given angular range of lever positions centered relative to the center lever position 56, such as a range of lever positions equal to about 1% to about 10% of the overall travel range 50 for the lever 20. Alternatively, the neutral position range 58 may only encompass the center lever position 56 such that the control lever 20 is only considered to be in "neutral" when disposed at the center lever position 56.

It should be appreciated that, in embodiments in which the control lever 20 is configured to control the operation of the tilt cylinder 34, movement of the control lever 20 from a position within the neutral position range 58 in a first direction (indicated by arrow 60 in FIG. 2 and also referred to herein as the "dumping direction") towards the first maximum position 52 may, for example, result in the flow rate of hydraulic fluid to one end of the tilt cylinders 34 being increased from a minimum flow towards a maximum flow according to an applicable transfer function correlating the lever position to the flow rate, thereby allowing the implement 30 to be tilted in a corresponding direction (e.g., towards a full dump position) at varying rates. Similarly, movement of the control lever 20 from a position within the neutral position range 58 in a second direction (indicated by arrow 62 in FIG. 2 and also referred to herein as the "curling direction") towards the second maximum position 54 may, for example, result in the flow rate of hydraulic fluid to the opposed end of the tilt cylinders 34 being increased from a minimum flow towards a maximum flow according to the applicable transfer function, thereby allowing the implement 30 to be tilted in an opposite direction (e.g., towards a fully curled position) at varying rates.

Additionally, as will be described in greater detail below, a controller of the disclosed system may be configured to monitor the position of the control lever 20 relative to one or more lever movement ranges defined within or across the overall travel range 50 for the lever 20. Specifically, in several embodiments, each lever movement range may correspond to a sub-range or subset of the full range of lever positions defined across the travel range 50. In such embodiments, the controller may be configured to monitor the movement of the control lever 20 to detect when the operator has moved the lever 20 relative to one of the lever movement ranges according to a predetermined or recognizable pattern. When such a pattern of lever movement is detected relative to a given lever movement range, the controller may be configured to switch to a new or adjusted transfer function associated with such lever movement range for correlating the lever positions to resulting flow rates. For instance, the controller may be configured to monitor the lever movement and determine when the operator has moved the control lever back and forth across a specific lever movement range a threshold number of times (e.g., two or more times) within a given time period (e.g., a period of 1-2 seconds). The detection of this particular pattern of movements relative to the associated lever movement range may then be interpreted by the controller as an indication that the operator desires to perform a certain implement movement (e.g., bucket shaking) or that the operator desires to control the movement of the implement 30 according to a particular operating mode (e.g., an implement shake mode or a precision movement mode). The controller may then access a predetermined transfer function associated with the lever movement range to allow the operation of the hydraulic system to be adjusted to provide the desired performance based on the desired implement movement and/or the desired mode of operation, such as by allowing for a more aggressive relationship between the lever position and the flow rate of hydraulic fluid to the tilt cylinders 34 to provide quicker responses to lever movements when rapid shaking of the implement 30 is desired.

As an illustrative example, in FIG. 2, three separate lever movement ranges have been defined across the travel range 50 of the control lever 20, namely a first lever movement range 70, a second lever movement range 72, and a third lever movement range 74. Specifically, the first lever movement range 70 extends across a range of lever positions defined between the first maximum position 52 and the neutral position range 58, with such movement range 70 being bounded by a first max range position (indicated by line 70A) and a first min range position (indicated by line 70B). The second lever movement range 72 extends across a range of lever positions defined between the second maximum position 54 and the neutral position range 58, with such movement range 72 being bounded by a second max range position (indicated by line 72A) and a second min range position (indicated by line 72B). As a result, the first and second lever movement ranges 70, 72 correspond to non-overlapping lever position ranges and, thus, do not include any overlapping lever positions. Additionally, as shown in FIG. 2, the third lever movement range 74 extends across a range of lever positions defined between the first and second maximum positions 52, 54 that spans across the neutral position range 58, with such movement range 74 being bounded by a third max range position (indicated by line 74A) and a third min range position (indicated by line 74B). As shown in the illustrated embodiment, the third lever movement range 74 overlaps portions of the first and second movement ranges 70, 72. As such, the first and third lever movement ranges 70, 74 and the second and third lever movement ranges 72, 74 include or incorporate overlapping lever position ranges.

It should be appreciated that the specific lever movement ranges 70, 72, 74 shown in FIG. 2 are simply provided as examples of suitable sub-ranges or lever position subsets that can be defined across the travel range 50 of the control lever 20. In other embodiments, the lever movement ranges may span across or encompass any other range of lever positions included within the overall travel range 50. In addition, each lever movement range may be defined relative to the other movement ranges in any suitable manner, such as by selecting the lever movement ranges such that all of the ranges include overlapping lever positions or by selecting the lever movement ranges such that all of the ranges correspond to non-overlapping position ranges. It should also be appreciated that any other suitable number of individual lever movement ranges may be defined across the travel range 50 for the control lever 20, such as less than three lever movement ranges (e.g., two lever movement ranges) or greater than three lever movement ranges (e.g., four or more lever movement ranges).

Additionally, it should be appreciated that, in several embodiments, a suitable position sensor 80 may be provided in operative association with the control lever 20 to allow the position of the lever 20 to be tracked or monitored across its travel range 50 (and relative to the various lever movement ranges 70, 72, 74). For instance, in one embodiment, a sensor 80 may be provided in operative association with the control lever 20 that detects the angular position of the lever 20 relative to a reference point, thereby allowing the position of the lever 20 across its travel range 50 to be accurately monitored as the lever 20 is being manipulated by the operator.

Figure 3:
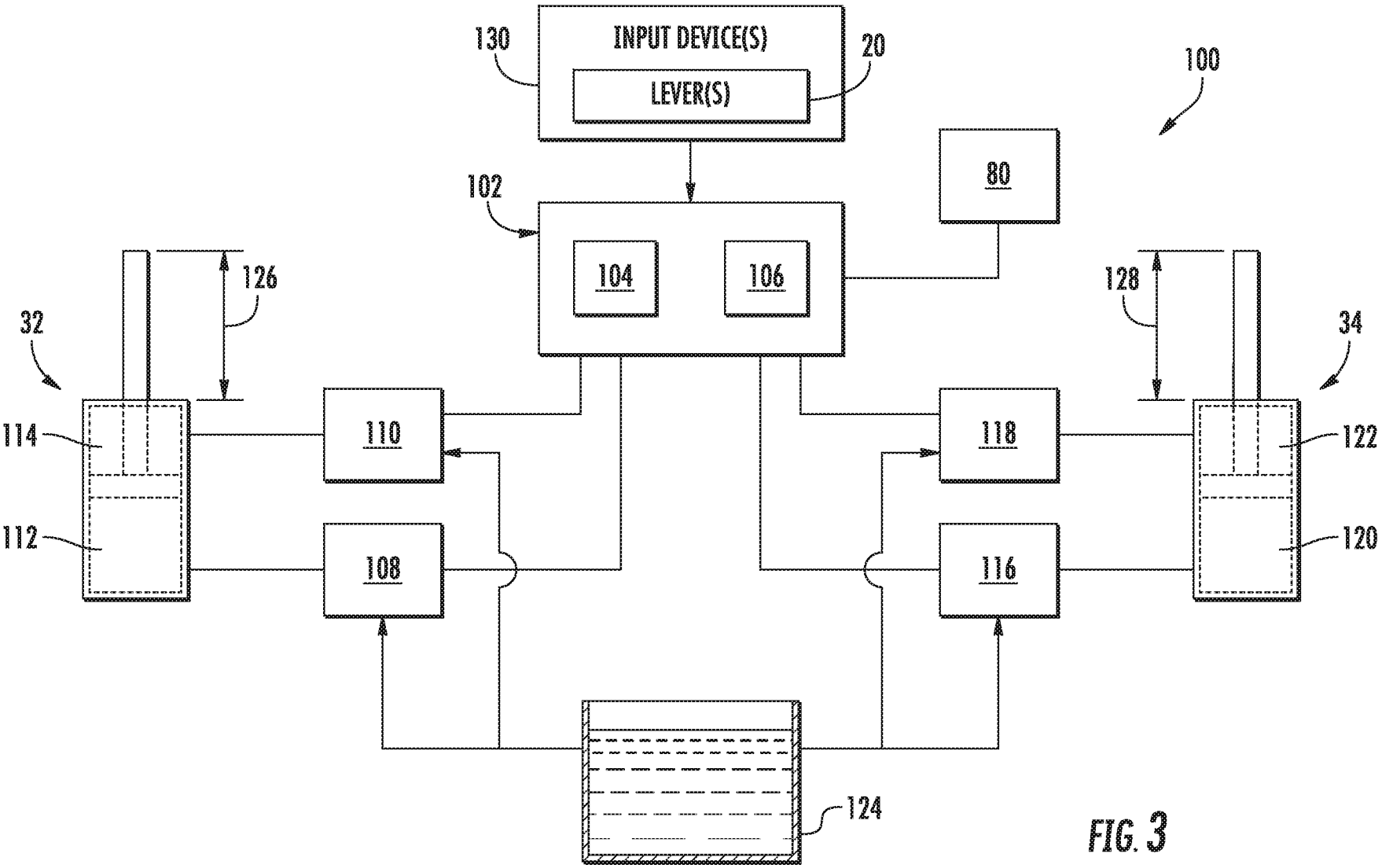
FIG. 3 illustrates a schematic diagram of one embodiment of a system for controlling the operation of a work vehicle in accordance with aspects of the present subject matter.

Referring now to FIG. 3, a schematic diagram of one embodiment of a system 100 for controlling the operation of a work vehicle is illustrated in accordance with aspects of the present subject matter. For purposes of discussion, the system 100 will be described herein with reference to the work vehicle 10 shown and described above with reference to FIG. 1. However, it should be appreciated that, in general, the disclosed system 100 may be utilized to control the operation of any work vehicle having any suitable vehicle configuration.

As shown, the system 100 may generally include a controller 102 configured to electronically control the operation of one or more components of the work vehicle 10, such as the various hydraulic components of the work vehicle 10 (e.g., the lift cylinders 32 and the tilt cylinders 34). In general, the controller 102 may comprise any suitable processor-based device known in the art, such as a computing device or any suitable combination of computing devices. Thus, in several embodiments, the controller 102 may include one or more processor(s) 104 and associated memory device(s) 106 configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) 106 of the controller 102 may generally comprise memory element(s) including, but not limited to, computer readable medium (e.g., random access memory (RAM)), computer readable non-volatile medium (e.g., a flash memory), a floppy disk a compact disc-read only memory (CD-ROM), a magneto-optical disk (MOD), a digital versatile disc (DVD) and/or other suitable memory elements. Such memory device(s) 106 may generally be configured to store suitable computer-readable instructions that, when implemented by the processor(s) 104, configure the controller 102 to perform various computer-implemented functions, such as by performing one or more aspects of the method 200 described below with reference to FIG. 8. In addition, the controller 102 may also include various other suitable components, such as a communications circuit or module, one or more input/output channels, a data/control bus and/or the like.

It should be appreciated that the controller 102 may correspond to an existing controller of the work vehicle 10 or the controller 102 may correspond to a separate processing device. For instance, in one embodiment, the controller 102 may form all or part of a separate plug-in module that may be installed within the work vehicle 10 to allow for the disclosed system and method to be implemented without requiring additional software to be uploaded onto existing control devices of the vehicle 10.

In several embodiments, the controller 102 may be configured to be coupled to suitable components for controlling the operation of the various actuators 32, 34 of the work vehicle 10. For example, as shown in FIG. 3, the controller 102 may be communicatively coupled to suitable valves 108, 110 (e.g., solenoid-activated valves) configured to control the supply of hydraulic fluid to each lift cylinder 32 (only one of which is shown in FIG. 3). Specifically, as shown in the illustrated embodiment, the system 100 may include a first lift valve 108 for regulating the supply of hydraulic fluid to a cap end 112 of each lift cylinder 32. In addition, the system 100 may include a second lift valve 110 for regulating the supply of hydraulic fluid to a rod end 114 of each lift cylinder 32. Moreover, the controller 102 may be communicatively coupled to suitable valves 116, 118 (e.g., solenoid-activated valves) configured to regulate the supply of hydraulic fluid to each tilt cylinder 34 (only one of which is shown in FIG. 3). For example, as shown in the illustrated embodiment, the system 100 may include a first control valve 116 for regulating the supply of hydraulic fluid to a cap end 120 of each tilt cylinder 34 and a second control valve 118 for regulating the supply of hydraulic fluid to a rod end 122 of each tilt cylinder 34.

During operation, hydraulic fluid may be transmitted to the PRVs 108, 110, 116, 118 from a fluid tank 124 mounted on and/or within the work vehicle 10 (e.g., via a pump (not shown)). The controller 102 may then be configured to control the operation of each valve 108, 110, 116, 118 in order to control the flow rate of hydraulic fluid supplied to each of the cylinders 32, 34. For instance, the controller 102 may be configured to transmit suitable control commands to the lift valves 108, 110 in order to regulate the flow of hydraulic fluid supplied to the cap and rod ends 112, 114 of each lift cylinder 32, thereby allowing for control of a stroke length 126 of the piston rod associated with each cylinder 32. Of course, similar control commands may be transmitted from the controller 102 to the control valves 116, 118 in order to control a stroke length 128 of the tilt cylinders 34. Thus, as an example, by carefully controlling the actuation or stroke length 128 of the tilt cylinders 34, the controller 102 may, in turn, be configured to automatically control the manner in which the implement 30 is pivoted or tilted relative to the loader arms 24, thereby allowing the controller 102 to control orientation of the implement 30 relative to the ground.

Additionally, as shown in FIG. 3, the controller 102 may be communicatively coupled to one or more input devices 130 for providing operator inputs to the controller 102. Such input device(s) 130 may generally correspond to any suitable input device(s) or human-machine interface(s) (e.g., a control panel, one or more buttons, levers, and/or the like) housed within the operator's cab 18 that allows for operator inputs to be provided to the controller 102. For example, in a particular embodiment, the input device(s) 130 may include one or more control levers (e.g., the control lever 20 described above with reference to FIG. 2) that allow the operator to transmit suitable operator inputs for controlling the various hydraulic components of the work vehicle 10, such as the lift and tilt cylinders 32, 34, thereby permitting the operator to control the position and/or movement of the loader arms 24 and/or implement 30. For instance, as described above with reference to FIG. 2, the operator may be allowed to move a control lever 20 forward or backward across its travel range 50 to indicate his/her desire to pivot or tilt the implement 30 relative to the loader arms 24 in one direction or the other (e.g., in a dumping direction or a curling direction).

In one embodiment, the input device(s) 130 may also include a suitable interface (e.g., a touch-screen display, buttons, knobs, and/or the like) to allow the operator to provide inputs associated with the aggressiveness of the transfer function being used to correlate the operator inputs provided via the control lever 20 to the control signals transmitted to the valve(s) 116, 118 for adjusting the flow rate to the associated tilt cylinders 34. For example, as will be described below, the operator may be allowed to select an aggressiveness setting (e.g., high/medium/low) when moving the implement 30 within a given operating mode to fine tune the responsiveness of the tilt cylinders 34 to the operator-initiated movements of the control lever 20.

Moreover, controller 102 may also be communicatively coupled to one or more sensors for monitoring one or more operating parameters of the work vehicle 10. For instance, as shown in FIG. 3, the controller 102 may be coupled to one or more position sensors 80 for monitoring the position of the control lever 20. As such, the controller 102 may track the position of the control lever 20 as it is being manipulated by the operator. Based on the appropriate transfer function being applied, the controller 102 may then correlate the position of the control lever 20 to an associated output or control signal for controlling the operation of the appropriate valve(s) 108, 110, thereby resulting in a corresponding flow rate of hydraulic fluid being supplied to the tilt cylinders 34.

Referring still to FIG. 3, it should be appreciated that the memory 106 of the controller 102 may be configured to store information accessible to the processor(s) 104, including data that can be retrieved, manipulated, created and/or stored by the processor(s) 104 and instructions that can be executed by the processor(s) 104. In several embodiments, the data may be stored in one or more databases. For example, the memory 106 may include a movement range database for storing data associated with the various different lever movement ranges defined for the control lever 20. For example, as indicated above with reference to FIG. 2, the travel range 50 for the control lever 20 may be sub-divided into a plurality of lever movement ranges (e.g., the first, second, and third lever movement ranges 70, 72, 74), with each range spanning a different sub-range or subset of the lever positions defined across the travel range 50. In such an embodiment, by monitoring the movement of the control lever 20 based on the data received from the position sensor(s) 80, the controller 102 may track such lever movements relative to the pre-defined lever movement ranges to determine when the operator is actuating the control lever 20 across or relative to a given movement range.

Additionally, the memory 106 of the controller 102 may also include an operating mode database storing data associated with the various different operating modes of the work vehicle. For example, as indicated above, the controller may be configured to execute various operating modes associated with controlling the movement of the implement 30, such as one or more implement shake modes, one or more precision movement modes, and/or the like. In such an embodiment, each individual operating mode may be associated with one of the lever movement ranges defined for the control lever 20 as well as activation pattern defining a specific pattern of lever movements that must be performed relative to the associated lever movement range for activating the operating mode. For instance, in the embodiment described above with reference to FIG. 2, each of the lever movement ranges 70, 72, 74 may be assigned to a particular operating mode of the work vehicle.

In addition, each operating mode may also be associated with a unique transfer function that correlates the movement of the control lever 20 to the flow rate of the hydraulic fluid to be supplied to the tilt cylinders 34. As such, the operating mode database within the controller's memory 106 may store such transfer functions in association with their respective operating modes. For instance, a more aggressive transfer function(s) may be associated with the implement shake mode(s) while a less aggressive transfer function(s) may be associated with the precision movement mode(s).

Moreover, in several embodiments, the instructions stored within the memory 106 of the controller 102 may be executed by the processor(s) 104 to implement a mode selection/activation module. In general, the mode selection/activation module may be configured to monitor the movement of the control lever 20 relative to the pre-defined lever movement ranges to determine when the operator has moved the control lever 20 across or relative to one of the lever movement ranges according to required activation pattern (e.g., movement back and forth across the lever movement range a threshold number of times within a given time period). When such a determination is made, the controller 102 may be configured to activate the operating mode associated with the relevant lever movement range. In doing so, the controller 102 may access the operating mode database within its memory 106 to determine the appropriate transfer function to be applied for the selected operating mode. The referenced transfer function may then be utilized to generate control signals for controlling the associated valve(s) 116, 118 based on the position of the control lever 20, thereby allowing the controller to regulate the flow rate to the tilt cylinders 34 in accordance with the inputs provided by the operator via the lever 20.

Figure 4A:
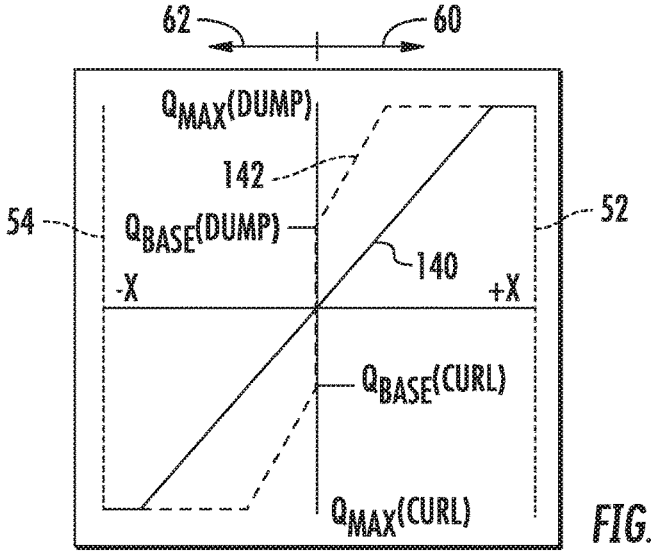
FIG. 4A illustrates an exemplary plot of a suitable transfer function that may be associated with a corresponding operating mode for controlling the movement of a work vehicle component in accordance with aspects of the present subject matter, particularly illustrating an exemplary transfer function for executing a balanced implement shake mode.
Figure 4B:
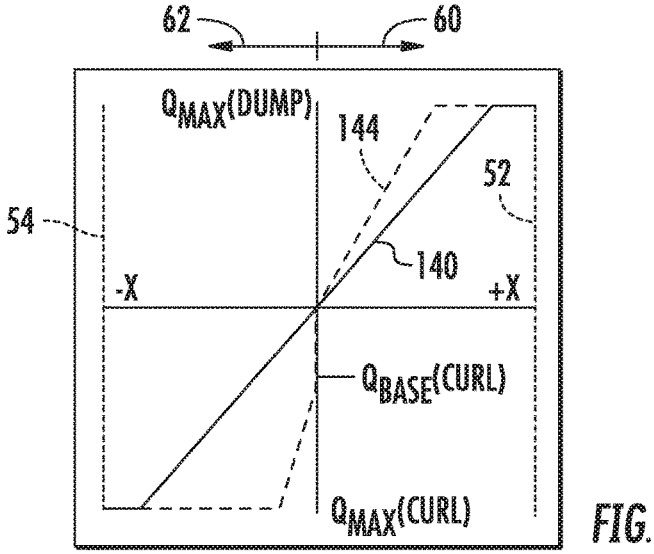
FIG. 4B illustrates another exemplary plot of a suitable transfer function that may be associated with a corresponding operating mode for controlling the movement of a work vehicle component in accordance with aspects of the present subject matter, particularly illustrating an exemplary transfer function for executing a curl-biased implement shake mode.
Figure 4C:
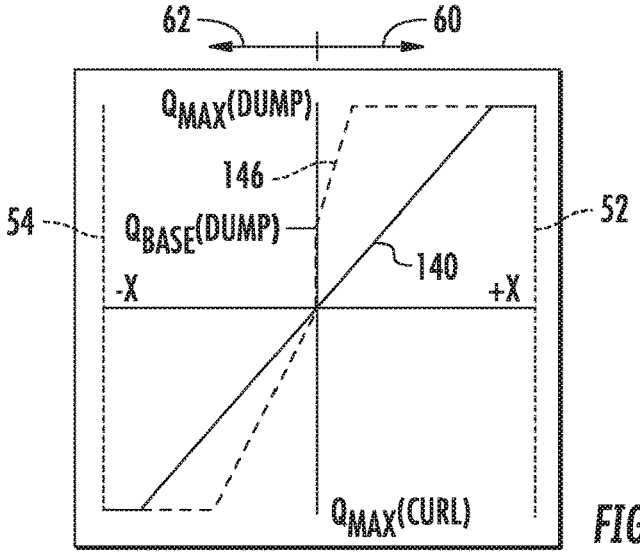
FIG. 4C illustrates a further exemplary plot of a suitable transfer function that may be associated with a corresponding operating mode for controlling the movement of a work vehicle component in accordance with aspects of the present subject matter, particularly illustrating an exemplary transfer function for executing a dump-biased implement shake mode.

Referring now to FIGS. 4A-4C, various example plots of suitable transfer functions that may be associated with corresponding operating modes for controlling the movement of the implement 30 of the work vehicle 10 are illustrated in accordance with aspects of the present subject matter. Specifically, the illustrated plots provide example transfer functions for executing different implement shake modes, such as a balanced implement shake mode (FIG. 4A), a curl-biased shake mode (FIG. 4B), and a dump-biased shake mode (FIG. 4C), relative to a default or baseline transfer function (indicated by solid line 140 in FIGS. 4A-4C) that is otherwise utilized during normal operation of the work vehicle 10. As shown in FIGS. 4A-4C, the control lever position (X) is plotted along the horizontal axis across the travel range 50 (FIG. 2) defined between the first and second maximum positions 52, 54 (with the neutral position range being defined at the origin) and the flow rate (Q) to the tilt cylinders 34 is plotted along the vertical axis, with the flow rate ranging from zero at the origin to maximum flow rates for moving the implement 30 in both the dumping direction ($Q_{MAX}$(dump)) and the curling direction ($Q_{MAX}$(curl)).

As shown in FIGS. 4A-4C, when operating in the default or normal operating mode, the baseline transfer function 140 is adapted such that a linear relationship exists between the lever position and the flow rate of hydraulic fluid supplied to the tilt cylinders 34. Specifically, as the control lever 20 is moved from the neutral position towards the first maximum position 52 in the first direction 60 to actuate the implement 30 toward its dump position, the flow rate increases at a constant rate until the maximum flow ($Q_{MAX}$(dump)) is reached. Similarly, as the control lever 20 is moved from the neutral position towards the second maximum position 54 in the second direction 62 to actuate the implement 30 toward its curl position, the flow rate increases at a constant rate until the maximum flow ($Q_{MAX}$(curl)) is reached. Such a correlation between the lever position and the flow rate is generally acceptable when performing most implement movements. However, when it is desired to quickly shake or move the implement 30 (e.g., to remove dirt or debris build-up), the linear ramp-up in flow rate is often insufficient. Accordingly, one or more of the implement shake modes may be executed to provide increased responsiveness to the operator-initiated movements of the control lever 20.

For example, FIG. 4A illustrates an adjusted transfer function (indicated by dashed line 142) for executing a balanced implement shake mode in which the flow rate to the tilt cylinders 34 is increased much more rapidly to the maximum flow rate in response to movements of the control lever 20 in both the first and second directions 60, 62. Specifically, unlike the constant linear relationship provided by the baseline transfer function 140, the adjusted transfer function 142 of FIG. 4A provides a stepwise increase in the flow rate immediately upon moving the control lever 20 out of the neutral position. For example, as the control lever 20 is moved out of the neutral position when actuating the implement toward its dump position, the flow rate is initiated at a base flow rate ($Q_{BASE}$(dump)) that is greater than zero (e.g., a flow rate ranging from 25% to 75% of the maximum flow rate) and is then increased at a relatively high rate over a shorter range of lever positions until the maximum flow ($Q_{MAX}$(dump)) is reached. Similarly, as the control lever 20 is moved out of the neutral position when actuating the implement toward its curl position, the flow rate is initiated at a base flow rate ($Q_{BASE}$(curl)) that is greater than zero (e.g., a flow rate ranging from 25% to 75% of the maximum flow rate) and is then increased at a relatively high rate over a shorter range of lever positions until the maximum flow ($Q_{MAX}$(curl)) is reached. As a result, the transfer function 142 provides a much more aggressive relationship between lever position and flow rate in both directions 60, 62 as compared to the baseline transfer function 140.

As another example, FIG. 4B illustrates an adjusted transfer function (indicated by dashed line 144) for executing a curl-biased implement shake mode in which the flow rate to the tilt cylinders 34 is increased much more quickly to the maximum flow rate in response to movements of the control lever 20 in the curling or second direction 62. As shown, similar to the adjusted transfer function 142 described above with reference to FIG. 4A, the transfer function 144 of FIG. 4B provides a stepwise increase in the flow rate immediately upon moving the control lever 20 out of the neutral position toward second maximum position 54. Specifically, as the control lever 20 is moved out of the neutral position when actuating the implement toward its curl position, the flow rate is initiated at a base flow rate ($Q_{BASE}$(curl)) that is greater than zero (e.g., a flow rate ranging from 25% to 75% of the maximum flow rate) and is then increased at a relatively high rate over a shorter range of lever positions until the maximum flow ($Q_{MAX}$(curl)) is reached. As a result, the transfer function 144 provides a much more aggressive relationship between the lever position and flow rate in the second direction 62 as compared to the baseline transfer function 140. Additionally, when moving the control lever 20 in the opposite direction toward first maximum position 52 to actuate the implement 30 to its dump position, the flow rate increases linearly from zero. However, as shown in FIG. 4B, the rate of increase in the flow rate provided by the adjusted transfer function 144 may be greater than the baseline transfer function 140 to provide increased responsiveness across a shorter range of lever positions when actuating the implement 30 in the dumping or first direction 60.

As yet another example, FIG. 4C illustrates an adjusted transfer function (indicated by dashed line 146) for executing a dump-biased implement shake mode in which the fluid rate to the tilt cylinders 34 is increased much more quickly to the maximum rate in response to movements of the control lever 20 in the dumping or first direction 60. As shown, similar to the transfer function 142 described above with reference to FIG. 4A, the adjusted transfer function 146 of FIG. 4C provides a stepwise increase in the flow rate immediately upon moving the control lever 20 out of the neutral position toward the first maximum position 52. Specifically, as the control lever 20 is moved out of the neutral position when actuating the implement 30 toward its dump position, the flow rate is initiated at a base flow rate ($Q_{BASE}$(dump)) that is greater than zero (e.g., a flow rate ranging from 25% to 75% of the maximum flow rate) and is then increased at a relatively high rate over a shorter range of lever positions until the maximum flow ($Q_{MAX}$(dump)) is reached. As a result, the transfer function provides a much more aggressive relationship between the lever position and flow rate in the first direction 60 as compared to the baseline transfer function 140. Additionally, when moving the control lever 20 in the opposite direction toward the second maximum position 54 to actuate the implement 30 to its curl position, the flow rate increases linearly from zero. However, as shown in FIG. 4C, the rate of increase in the flow rate provided by the transfer function 146 may be greater than the baseline transfer function 140 to provide increased responsiveness across a shorter range of lever positions when actuating the implement in the curling or second direction 62.

It should be appreciated that, in one embodiment, each of the various implement shake modes described above may be assigned to a given lever movement range to allow the operator to select or activate one of such operating modes based on movement of the control lever 20 across the associated lever movement range according to the required activation pattern. For instance, with reference to the embodiment of FIG. 2, the first lever movement range 70 may be associated with selection of the dump-biased implement shake mode of FIG. 4C, the second lever movement range 72 may be associated with the curl-biased implement shake mode of FIG. 4B, and the third lever movement range 74 may be associated with the balanced implement shake mode of FIG. 4C. Thus, as an example, the controller 102 may activate the dump-biased implement shake mode or the curl-biased implement shake mode when it is detected that the operator has moved the control lever 20 back and forth across the first lever movement range 70 or the second lever movement range 72, respectively, a threshold number of times within a given time period. Similarly, the controller 102 may activate the balanced implement shake mode when it is detected that the operator has moved the control lever 20 back and forth across the third lever movement range 74 a threshold number of times within a given time period.

Figure 5:
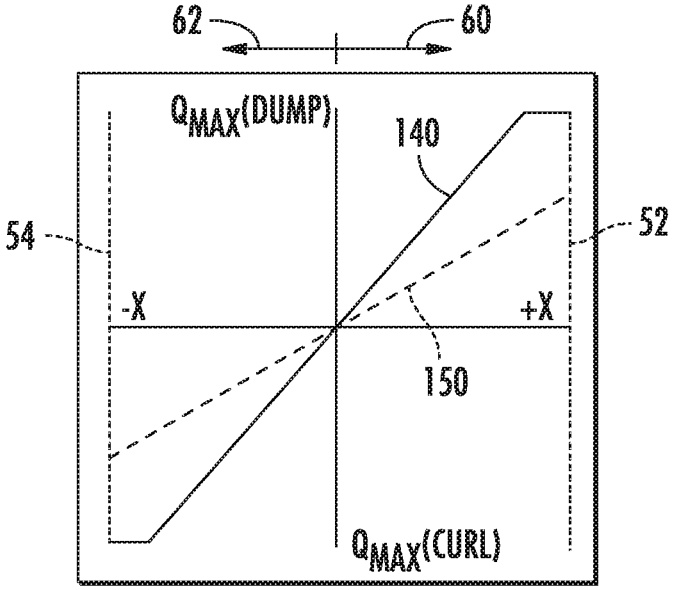
FIG. 5 illustrates yet another exemplary plot of a suitable transfer function that may be associated with a corresponding operating mode for controlling the movement of a work vehicle component in accordance with aspects of the present subject matter, particularly illustrating an exemplary transfer function for executing a precision movement mode.

Referring now to FIG. 5, another example plot of a suitable transfer function that may be associated with a corresponding operating mode for controlling the movement of the implement 30 of the work vehicle 10 is illustrated in accordance with aspects of the present subject matter. Specifically, the illustrated plot provides an example adjusted transfer function (indicated by dashed line 150) for executing a precision movement mode when it is desired to very precisely and accurately control the movement of the implement 30. As shown, FIG. 5 illustrates the same baseline transfer function 140 as that described above with reference to FIGS. 4A-4C. Additionally, similar to the baseline transfer function 140, the adjusted transfer function 150 is shown as providing a linear relationship between the lever position and the flow rate of hydraulic fluid to the tilt cylinders 34. However, the adjusted transfer function 150 increases the flow rate at a much slower rate. Specifically, as the control lever 20 is moved from the neutral position in the first direction 60 towards the first maximum position 52 to actuate the implement 30 toward its dump position, the flow rate increases at a constant rate until the first maximum position 52 is reached (and without reaching the maximum flow rate ($Q_{MAX}$(dump))). Similarly, as the control lever 20 is moved from the neutral position in the second direction 62 towards the second maximum position 54 to actuate the implement 30 toward its curl position, the flow rate increases at a constant rate until the second maximum position 54 is reached (and without reaching the maximum flow rate ($Q_{MAX}$(curl))). Thus, as compared to the baseline transfer function 140, the adjusted transfer function 150 provides for a significantly less aggressive relationship between lever position and flow rate to allow for more precise control of the resulting movements of the implement 30.

It should be appreciated that, similar to the various adjusted transfer functions 142, 144, 146 and corresponding operating modes described above with reference to FIGS. 4A-4C, the precision movement mode may be assigned to a given lever movement range to allow the operator to select or activate such operating mode based on movement of the control lever 30 across the associated lever movement range according to the required activation pattern. It should also be appreciated that, similar to the transfer functions 142, 144, 146 described above, multiple different precision movement modes may be executed for the controller 102. For instance, FIG. 5 provides an example transfer function for implementing a more balanced precision movement mode. In addition to such mode (or as an alternative thereto), suitable transfer functions may also be provided to implement a dump-biased precision movement mode in which a less aggressive relationship is defined between lever position and flow rate when moving the control lever 20 in the dumping or first direction 60 and/or a curl-biased precision movement mode in which a less aggressive relationship is defined between lever position and flow rate when moving the control lever 20 in the curling or second direction 62.

Figure 6:
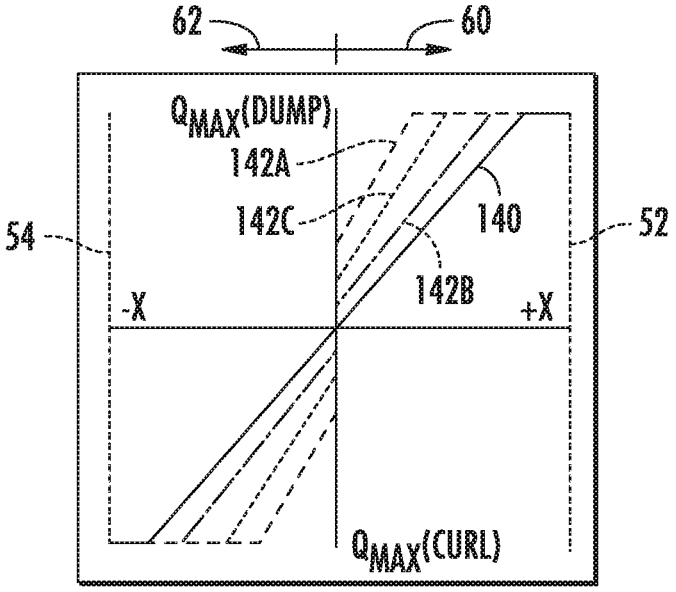
FIG. 6 illustrates another exemplary plot of suitable transfer functions that may be associated with corresponding operating modes for controlling the movement of a work vehicle component in accordance with aspects of the present subject matter, particularly illustrating exemplary transfer function for executing a balanced implement shake mode according to different aggressiveness settings for the operating mode.

Referring now to FIG. 6, another example plot of suitable transfer functions that may be associated with corresponding operating modes for controlling the movement of the implement 30 of the work vehicle 10 are illustrated in accordance with aspects of the present subject matter. Specifically, the illustrated plot provides example adjusted transfer functions 142A, 142B, 142C for executing several different balanced implement shake modes, with each operating mode being associated with a different aggressiveness setting. As indicated above, when implementing a given type of operating mode, the operator may be allowed to select a given aggressiveness setting (e.g., high/medium/low). Thus, in the illustrated example, the various transfer functions 142A, 142B, 142C correspond to high/medium/low aggressiveness settings for the transfer function 142A associated with the balanced implement shake mode described above with reference to FIG. 4A. As shown, a first transfer function 142A is defined that provides a highly aggressive relationship between lever position and flow rate when moving the control lever 20 in both the dumping and curling directions 60, 62 while a second transfer function 142B is defined that provides a much less aggressive relationship between lever position and flow rate when moving the control lever 20 in such directions 60, 62 than the first transfer function 142B (while still being more aggressive than the baseline transfer function 140). Additionally, a third transfer function 142C is defined that provides an intermediate level of aggressiveness between lever position and flow rate when moving the control lever 20 in both the dumping and curling directions 60, 62 (e.g., as compared to the first and second transfer functions 142A, 142B). Thus, by selecting a given aggressiveness setting, the operator may fine tune the transfer function for the selected operating mode to provide for desired responsiveness to lever movements.

It should be appreciated that similar aggressiveness settings may also be applied to any of the other operating modes described herein, such as any of the other implement shake modes and/or any of the precision movement modes. Additionally, it should be appreciated that, by providing the operator with the ability to select from different aggressiveness settings, the various combination of different transfer functions that may be applied in a given scenario increases significantly. For example, referring back to the embodiments described above with reference to FIGS. 2 and 4A-4C (and assuming that three different aggressiveness settings are available for each operating mode), the operator may select between the different implement shake modes (e.g., the balanced shaking mode, the dump-biased shaking mode, and the curl-biasing shaking mode) by moving the control lever 20 across the associated lever movement range (e.g., the first, second, or third lever movement range 70, 72, 74) and may further select an aggressiveness setting for the selected operating mode (e.g., high/medium/low), thereby providing the operator with nine different options for selecting a transfer function to that meets the operator's performance requirements.

As described above, FIGS. 4-6 (including FIGS. 4A, 4B, 4C) provide various examples of suitable transfer functions that may be utilized when controlling the movement of the implement 30 within a given non-default operating mode. It should be appreciated that, once one of such operating modes has been activated (e.g., by detecting the required movement pattern by the control lever 20 relative to the associated lever movement range), the operating mode may, for example, by automatically de-activated by the controller 102 upon detection of a given trigger event(s), thereby returning the control of the various hydraulic components back to their normal or default operating mode (e.g., operation using the baseline transfer function 140 described above). Such trigger event(s) for deactivating a given operating mode may, for example, include, but are not limited to, detection by the controller 102 that the control lever 20 has been maintained at the neutral position for longer than a predetermined time period, detection by the controller 102 that the control lever 20 at another position for longer than a predetermined time period (e.g., the first or second maximum position 52, 54), and/or detection by the controller 102 that the lever oscillation frequency relative to a given lever movement range has dropped below a predetermined threshold (e.g., detection that the operator is no longer actuating the control lever 20 in quick back and forth motions).

Figure 7:
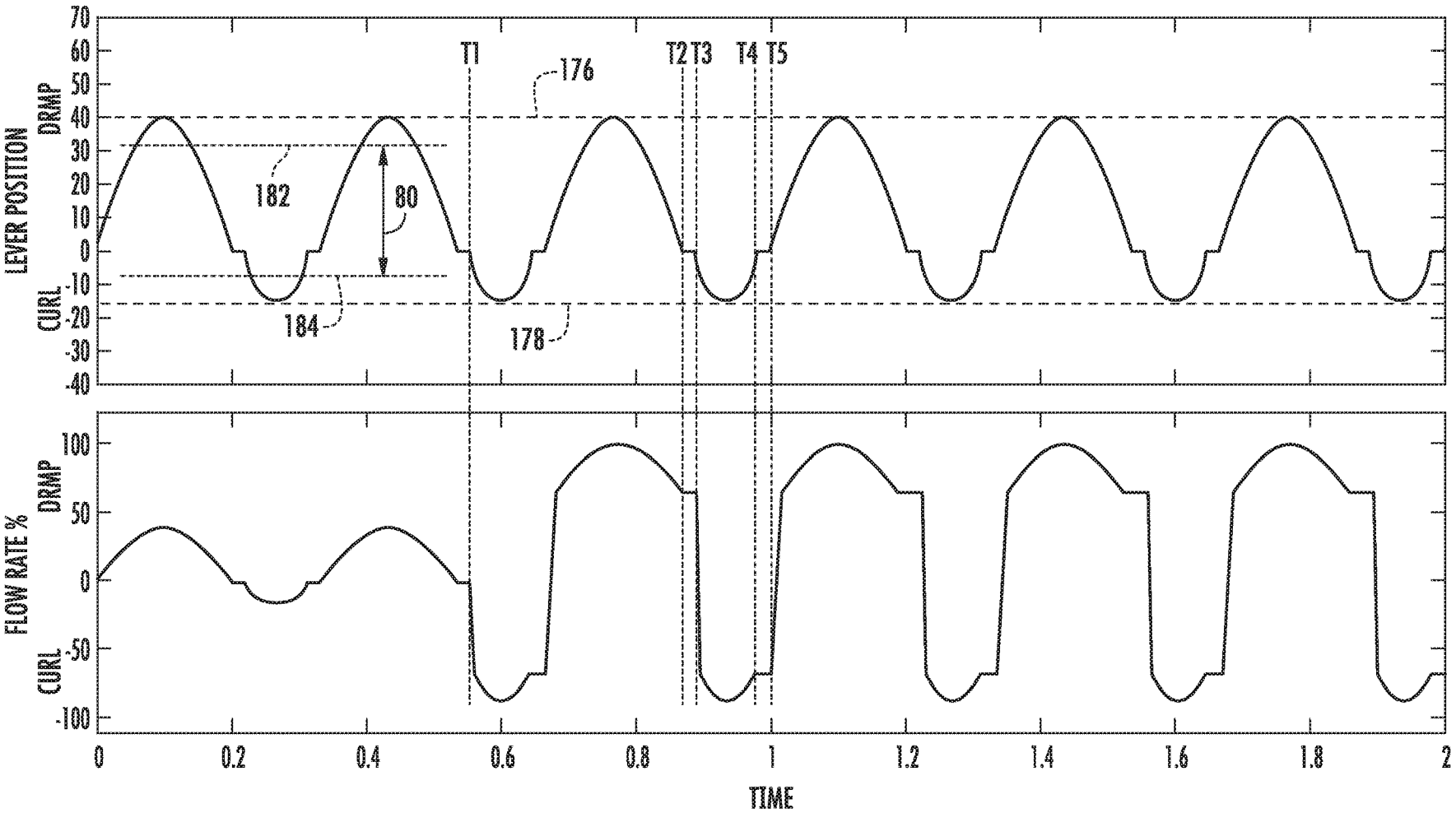
FIG. 7 illustrates an exemplary plot of both lever position and flow rate versus time, particularly illustrating an example of the activation of an implement shake mode upon recognizing a given pattern of lever movements relative to a pre-defined lever movement range.

Referring now to FIG. 7, an exemplary plot of both lever position (i.e., the top graph) and flow rate percentage (i.e., the bottom graph) with reference to time is illustrated in accordance with aspects of the present subject matter, particularly illustrating an example of the activation of an implement shake mode upon recognizing a given pattern of movements relative to a pre-defined lever movement range. In the illustrated embodiment, the lever position plot shows that the operator is rapidly moving the control lever back and forth in an attempt to shake the implement 30. Specifically, as shown in FIG. 3, the control lever 20 is being continuously moved back and forth by the operator across the lever's neutral position range (identified within the plot at a lever position of zero) between a maximum lever position (indicated by line 176) and a minimum lever position (indicated by line 178). Additionally, in the illustrated embodiment, a lever movement range 180 is defined for the control lever 20 between a first joystick position (indicated by line 182) and a second joystick position (indicated by line 184). As shown in FIG. 3, given the amplitude of the lever movements between the maximum and minimum lever positions 176, 178, the control lever 20 is being actuated by the operator back and forth across the lever movement range 180.

By recognizing a pre-defined pattern of movements relative to the lever movement range 180, the controller 102 may be configured to activate an implement shake mode associated with such lever movement range 180, thereby altering the transfer function being applied for correlating the joystick position to the flow rate. For instance, as shown in FIG. 7, upon initiation of the lever movements (e.g., at time=0) to time $T_1$, a default or normal transfer function is being applied to the lever position inputs. As a result, the amplitude of the change in flow rate across such time period is relatively small in response to the lever movements between the maximum and minimum lever positions 176, 178, thereby preventing rapid shaking of the implement 30. However, as the movement of the control lever 20 is monitored relative to the lever movement range 180, the controller 102 recognizes (e.g., at time $T_1$) that the control lever 20 has been moved across such movement range 180 according to the associated activation pattern (e.g., movement back and forth across the range 180 at least twice within a time period of less than one second). Thus, as shown in FIG. 7, at time $T_1$, the implement shake mode is automatically activated by the controller 102 such that a new, more aggressive transfer function is applied to the lever position inputs. Specifically, following time $T_1$, the more aggressive transfer function results in rapid increases in the flow rate as the lever position is moved back and forth between the maximum and minimum lever positions 176, 178, thereby allowing for more effective shaking of the implement 30.

Additionally, in one embodiment, the controller 102 may be configured to maintain the flow rate constant as the operator moves the control lever 20 across its neutral position range while operating within the implement shake mode. For instance, as shown in FIG. 7, the control lever 20 is moved across its neutral position range at various different time periods, such as the time period defined between time $T_2$ and time $T_3$ and the time period defined between time $T_4$ and time $T_5$. Additionally, as shown in FIG. 7, the flow rate is maintained constant across such time periods. For example, upon entering the neutral position range, the controller may be configured to hold or fix the commanded flow rate at the flow rate commanded immediately prior to entering the neutral position range. Thereafter, upon exiting neutral position range, the controller 102 may update the commanded flow rate based on the applicable transfer function, such as by commanding a stepwise change in the flow rate. It should be appreciated that, by maintaining the commanded flow rate constant across the neutral position range, higher implement acceleration values may be achieved during the shaking procedure as the lever 20 passes through such neutral range.

Figure 8:
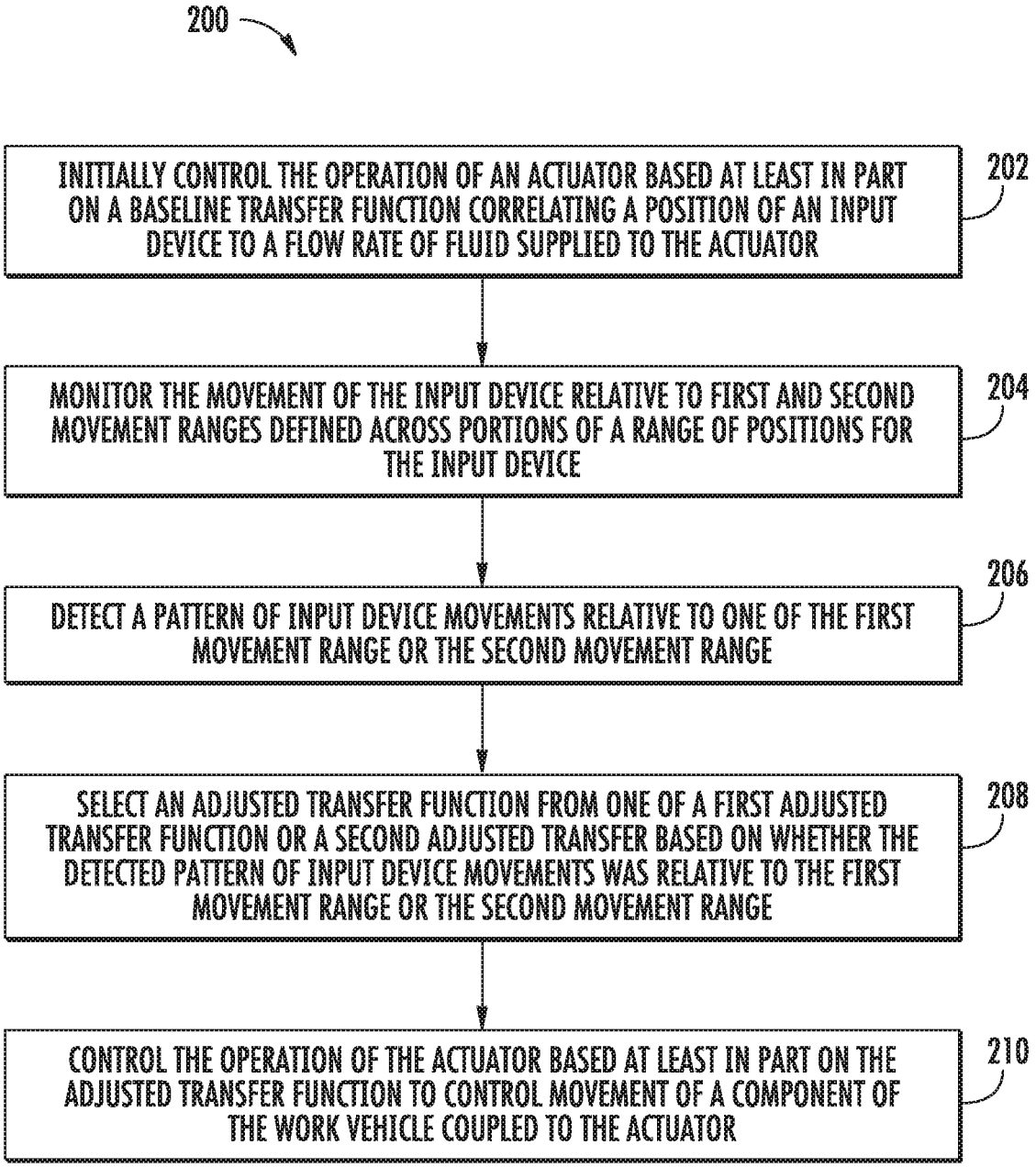
FIG. 8 illustrates a flow diagram of one embodiment of a method for controlling the operation of a work vehicle in accordance with aspects of the present subject matter.

Referring now to FIG. 8, a flow diagram of one embodiment of a method 200 for controlling the operation of a work vehicle is illustrated in accordance with aspects of the present subject matter. In general, the method 200 will be described herein with reference to the system 100 described above with reference to FIG. 3. However, it should be appreciated by those of ordinary skill in the art that the disclosed method 200 may be implemented within any other system having any other suitable system configuration. In addition, although FIG. 3 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 3, at (202), the method 200 may include initially controlling the operation of an actuator based at least in part on a baseline transfer function correlating a position of an input device to a flow rate of fluid supplied to the actuator. Specifically, as indicated above, when operating within a normal or default operating mode, the operation of the tilt cylinders 34 (and, thus, the movement of the implement 30) may be controlled by the controller 102 based on a default or baseline transfer function that correlates the operator-controlled position of the control lever to the flow rate of the fluid being supplied to the tilt cylinders 34.

Additionally, at (204), the method 200 may include monitoring the movement of the input device relative to first and second movement ranges defined across portions of a range of positions for the input device. Specifically, as indicated above, the overall range of positions 50 for the control lever 20 may be subdivided into two or more lever movement ranges, with each lever movement range corresponding to a different sub-range or subset of lever positions across the overall range of lever positions 50. In such an embodiment, the various lever movement ranges may correspond to overlapping lever ranges and/or non-overlapping lever ranges. Regardless, by subdividing the range of positions 50 into two or more lever movement ranges, the controller 102 may be configured to monitor the movement of the control lever 20 relative to the lever movement ranges.

Moreover, at (206), the method 200 includes detecting a pattern of input device movements relative to one of the first movement range or the second movement range. Specifically, as indicated above, by monitoring the movement of the control lever 20, the controller 102 may be configured to detect when the operator moves the lever 20 according to a predetermined pattern of lever movements relative to one of the lever movement ranges. For instance, the controller 102 may be configured to detect when the control lever 20 is moves back and forth across a given lever movement range a minimum number of times across a given time period.

Referring still to FIG. 8, at (208), the method 200 includes selecting an adjusted transfer function for correlating the position of the input device to the flow rate from one of a first adjusted transfer function associated with the first movement range or a second adjusted transfer function associated with the second movement range based on whether the detected pattern of input device movements was relative to the first movement range or the second movement range. Specifically, as indicated above, each lever movement range may be associated with a transfer function that differs from both the baseline transfer function and the transfer functions associated with the other lever movement ranges. As such, by selecting the transfer function assigned to the lever movement range across which the pattern of lever movements was detected, the manner in which the tilt cylinder is being controlled may be adjusted in accordance with the operating mode with which the selected transfer function is associated.

Additionally, at (210), the method includes controlling the operation of the actuator based at least in part on the adjusted transfer function to control movement of a component of the work vehicle coupled to the actuator. Specifically, upon selecting the transfer function assigned to the lever movement range across which the pattern of lever movements was detected, the controller 102 may be configured to utilize the transfer function to control the movements of the implement 30. For instance, the selected transfer function may be used to convert the lever position inputs provided by the operator to control outputs for controlling the flow rate of the hydraulic fluid supplied to the tilt cylinders 34, thereby allowing the movement of the implement 30 to be automatically controlled by the controller 102.

It is to be understood that the steps of the method 200 are performed by the controller 102 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the controller 102 described herein, such as the method 200, is implemented in software code or instructions which are tangibly stored on a tangible computer readable medium. The controller 102 loads the software code or instructions via a direct interface with the computer readable medium or via a wired and/or wireless network. Upon loading and executing such software code or instructions by the controller 102, the controller 102 may perform any of the functionality of the controller 102 described herein, including any steps of the method 200 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling the operation of a work vehicle, the method comprising:

initially controlling, with a computing device, an operation of an actuator of a work vehicle based at least in part on a baseline transfer function correlating a position of an input device of the work vehicle to a flow rate of fluid supplied to the actuator, the input device being movable across a range of positions;

monitoring, with the computing device, movement of the input device relative to first and second movement ranges defined across portions of the range of positions, the first movement range corresponding to a first sub-range of the range of positions and the second movement range corresponding to a second sub-range of the range of positions, the first sub-range of positions differing from the second sub-range of positions;

detecting, with the computing device, a pattern of input device movements relative to one of the first movement range or the second movement range;

selecting, with the computing device, an adjusted transfer function for correlating the position of the input device to the flow rate from one of a first adjusted transfer function associated with the first movement range or a second adjusted transfer function associated with the second movement range based on whether the detected pattern of input device movements was relative to the first movement range or the second movement range, the first and second adjusted transfer functions differing from each other and from the baseline transfer function; and controlling, with the computing device, the operation of the actuator based at least in part on the adjusted transfer function to control movement of a component of the work vehicle coupled to the actuator.

2. The method of claim 1, wherein detecting the pattern of input device movements comprises detecting when the input device is moved across the one of the first movement range or the second movement range a threshold number of times within a given time period.

3. The method of claim 1, further comprising receiving an input associated with a selection of an aggressiveness setting for controlling the movement of the component;

wherein the adjusted transfer function is selected based at least in part on the aggressiveness setting.

4. The method of claim 1, wherein the range of positions comprises a neutral position range that spans across an angular range of input device positions, the computing device being adapted to maintain the fluid rate constant as the input device is moved across the angular range of input device positions associated with the neutral position range.

5. The method of claim 1, wherein the first and second sub-ranges correspond to overlapping sub-ranges within the range of positions for the input device.

6. The method of claim 1, wherein the first and second sub-ranges correspond to non-overlapping sub-ranges within the range of positions for the input device.

7. The method of claim 1, wherein controlling the operation of the actuator comprises controlling the operation of a valve configured to regulate the flow rate of the fluid supplied to the actuator.

8. The method of claim 1, wherein the adjusted transfer function is associated with one of a shake mode or a precision movement mode for the work vehicle.

9. The method of claim 1, wherein the first and second adjusted transfer functions differ with reference to an aggressiveness of the relationship defined between the position of the input device and the flow rate when moving the input device in at least one of a first direction or an opposite second direction relative to a neutral position for the input device.

10. The method of claim 1, wherein the input device corresponds to a control lever of the work vehicle.

11. The method of claim 1, wherein the component comprises an implement supported by at least one loader arm of the work vehicle, the actuator corresponding to a tilt cylinder coupled to the implement.

12. The method of claim 1, wherein the input device corresponds to a control lever of the work vehicle.

13. A system for controlling the operation of a work vehicle, the system comprising:

an implement;

an actuator coupled to the implement, the actuator configured to move the implement across a plurality of implement positions;

an input device configured to receive operator inputs for controlling the operation of the actuator based on a position of the input device, the input device being movable across a range of positions; and a controller communicatively coupled to the input device, the controller being configured to:

initially control the operation of the actuator based at least in part on a baseline transfer function correlating the position of the input device to a flow rate of fluid supplied to the actuator;

monitor the movement of the input device relative to first and second movement ranges defined across portions of the range of positions of the input device, the first movement range corresponding to a first sub-range of the range of positions and the second movement range corresponding to a second sub-range of the range of positions, the first sub-range of positions differing from the second sub-range of positions;

detect a pattern of input device movements relative to one of the first movement range or the second movement range;

select an adjusted transfer function for correlating the position of the input device to the flow rate from one of a first adjusted transfer function associated with the first movement range or a second adjusted transfer function associated with the second movement range based on whether the detected pattern of input device movements was relative to the first movement range or the second movement range, the first and second adjusted transfer functions differing from each other and from the baseline transfer function; and control the operation of the actuator based at least in part on the adjusted transfer function to control the movement of the implement.

14. The system of claim 13, wherein the controller is configured to detect the pattern of input device movements by detecting when the input device is moved across the one of the first movement range or the second movement range a threshold number of times within a given time period.

15. The system of claim 13, wherein the controller is further configured to receive an input associated with a selection of an aggressiveness setting for controlling the movement of the implement, the adjusted transfer function being selected based at least in part on the aggressiveness setting.

16. The system of claim 13, wherein the range of positions comprises a neutral position range that spans across an angular range of input device positions, the controller being adapted to maintain the fluid rate constant as the input device is moved across the angular range of input device positions associated with the neutral position range.

17. The system of claim 13, wherein the first and second sub-ranges correspond to overlapping or non-overlapping sub-ranges within the range of positions for the input device.

18. The system of claim 13, further comprising a valve configured to regulate the flow rate of the fluid supplied to the actuator, the controller being configured to control the operation of the actuator by controlling the operation of the valve.

19. The system of claim 13, wherein the adjusted transfer function is associated with one of a shake mode or a precision movement mode for the work vehicle.

20. The system of claim 13, wherein the first and second adjusted transfer functions differ with reference to an aggressiveness of the relationship defined between the position of the input device and the flow rate when moving the input device in at least one of a first direction or an opposite second direction relative to a neutral position for the input device.

* * * * *